US006778635B1

(12) United States Patent
Richardson

(10) Patent No.: US 6,778,635 B1
(45) Date of Patent: Aug. 17, 2004

(54) X-RAY TUBE COOLING SYSTEM

(75) Inventor: John E. Richardson, Salt Lake City, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 115 days.

(21) Appl. No.: 10/043,393

(22) Filed: Jan. 10, 2002

(51) Int. Cl.[7] ..... H01J 35/10
(52) U.S. Cl. ..... 378/130; 378/142
(58) Field of Search ..... 378/130, 127, 378/141, 142, 199, 200, 194

(56) References Cited

U.S. PATENT DOCUMENTS

| | | | | |
|---|---|---|---|---|
| 3,870,916 A | | 3/1975 | Kussel et al. | 313/32 |
| 3,942,059 A | | 3/1976 | Tran-Quang | 313/60 |
| 4,071,768 A | | 1/1978 | Goodenough | 250/444 |
| 4,281,268 A | | 7/1981 | Sawa et al. | 313/60 |
| 4,674,109 A | | 6/1987 | Ono | 378/130 |
| H312 H | | 7/1987 | Parker | 378/127 |
| 4,685,119 A | | 8/1987 | Bird et al. | 378/130 |
| 4,928,296 A | | 5/1990 | Kadambi | 378/141 |
| 5,416,820 A | | 5/1995 | Weil et al. | 378/130 |
| 5,541,975 A | | 7/1996 | Anderson et al. | 378/130 |
| 5,579,364 A | | 11/1996 | Osaka et al. | 378/130 |
| 5,696,808 A | | 12/1997 | Lenz | 378/121 |
| 6,011,829 A | | 1/2000 | Panasik | 378/130 |
| 6,041,100 A | | 3/2000 | Miller et al. | 378/141 |
| 6,097,789 A | | 8/2000 | Mueller | 378/130 |
| 6,134,299 A | * | 10/2000 | Artig | 378/121 |
| 6,160,868 A | * | 12/2000 | Snyder et al. | 378/127 |
| 6,445,769 B1 | * | 9/2002 | Panasik et al. | 378/130 |
| 6,519,317 B2 | * | 2/2003 | Richardson et al. | 378/130 |

FOREIGN PATENT DOCUMENTS

| | | | |
|---|---|---|---|
| JP | 53-126887 | * 11/1978 | H01J/35/10 |

* cited by examiner

*Primary Examiner*—Edward J. Glick
*Assistant Examiner*—Chih-Cheng Glen Kao
(74) *Attorney, Agent, or Firm*—Workman Nydegger

(57) ABSTRACT

An x-ray tube cooling system including a heat sink at least partially disposed within an evacuated housing of the x-ray tube and having a cooling block partially received within the bearing housing so as to absorb heat transmitted to the bearing assembly and bearing housing. Extended surfaces, are disposed in a coolant chamber cooperatively defined by the cooling block and a shell within which the cooling block is partially received. The shell defines a coolant chamber entrance and coolant chamber exit in fluid communication with the coolant chamber. The coolant chamber entrance and exit communicate with corresponding coolant inlet and outlet passageways, respectively, cooperatively defined by a pair of insulators which retain the heat sink in a predetermined orientation within an evacuated envelope of an x-ray device. A circulating coolant contacts the extended surfaces and thereby removes heat from various structures of the x-ray device.

24 Claims, 4 Drawing Sheets

X-RAY TUBE COOLING SYSTEM

BACKGROUND OF THE INVENTION

1. The Field of the Invention

The present invention relates generally to x-ray tubes that use a rotating anode target supported by a bearing assembly. More particularly, embodiments of the present invention relate to systems and devices concerned with improving the rate of heat transfer from the x-ray tube bearing assembly and related components so as to facilitate a relative increase in the life of the bearing assembly, and thus the x-ray device as a whole.

2. The Relevant Technology

X-ray producing devices are valuable tools that are used in a wide variety of industrial, medical, and other applications. For example, such equipment is commonly used in areas such as diagnostic and therapeutic radiology, semiconductor manufacture and fabrication, and materials analysis and testing. While they are used in various applications, the different x-ray devices share the same underlying operational principles. In general, x-rays, or x-ray radiation, are produced when electrons are produced, accelerated, and then impinged upon a material of a particular composition.

Typically, these processes are carried out within a vacuum enclosure. Disposed within the vacuum enclosure is an electron source, or cathode, and an anode, which is spaced apart from the cathode. In operation, electrical power is applied to a filament portion of the cathode, which causes a stream of electrons to be emitted by the process of thermionic emission. A high voltage potential applied across the anode and the cathode causes the electrons emitted from the cathode to rapidly accelerate towards a target surface, or focal track, positioned on the anode.

The accelerating electrons in the stream strike the target surface, typically a refractory metal having a high atomic number, at a high velocity and a portion of the kinetic energy of the striking electron stream is converted to electromagnetic waves of very high frequency, or x-rays. The resulting x-rays emanate from the target surface, and are then collimated through a window formed in the x-ray tube for penetration into an object, such as the body of a patient. As is well known, the x-rays can be used for therapeutic treatment, or for x-ray medical diagnostic examination or material analysis procedures.

In addition to stimulating the production of x-rays, the kinetic energy of the striking electron stream also causes a significant amount of heat to be produced in the anode. As a result, the anode typically experiences extremely high operating temperatures. However, the anode is not the only element of the x-ray tube subjected to such extreme operating temperatures.

In particular, a percentage of the electrons that strike the target surface do not generate x-rays, and instead simply rebound from the surface and then impact another "non-target" surfaces and structures within the x-ray tube evacuated enclosure. These are often referred to as "secondary" electrons. These secondary electrons retain a large percentage of their kinetic energy after rebounding, and when they impact non-target surfaces, a significant amount of heat is generated that is conducted to various other elements, such as the bearing assembly, of the x-ray device.

The heat produced by secondary electrons, in conjunction with the high temperatures present at the target anode, often reaches levels high enough to damage portions of the x-ray tube structure. In particular, such extreme temperature operating conditions can shorten the operational life of the x-ray device, affect its efficiency and performance, and/or render it inoperable. Such high heat levels present special problems in the context of rotating anode type x-ray tubes.

In a typical rotating anode type x-ray tube, the anode is mounted to a shaft that is rotatably supported by a bearing assembly contained in a bearing housing. A stator serves to rotate the shaft, and the anode accordingly rotates as well. As the anode rotates, each point on the focal track is rotated into and out of the path of the electron beam generated by the cathode. In this way, the electron beam is in contact with a given point on the focal track for only short periods of time, thereby allowing the remaining portion of the focal track to cool during the time that it takes such given portion to rotate back into the path of the electron beam.

The rotating anode x-ray tube of this sort is used in a variety of applications, some of which require that the anode be rotated at relatively high speeds so as to maintain an acceptable heat distribution along the focal track. For instance, x-ray tubes used in mammography equipment have typically been operated with anode rotation speeds around 3500 revolutions per minute (rpm). However, the demands of the industry have continued to change and high-speed machines for mammography and other applications are now being produced that operate at anode rotation speeds of around 10,000 rpm and higher.

High rotational speeds coupled with extreme operating temperatures place tremendous stress and strain on the bearing assembly and related components of the rotating anode x-ray tube, resulting in a variety of undesirable consequences. For example, high rotational speeds and operating temperatures may cause increased vibration and noise in the bearing assembly. This increase in noise and vibration is undesirable, because it can be unsettling to a patient, particularly in applications such as mammography where the patient is in intimate contact with the x-ray machine. Moreover, noise and vibration can be distracting to the x-ray machine operator. Also, unchecked vibration can shorten the operating life of the x-ray tube. Finally, the quality of the images produced by the x-ray device are at least partly a function of the stability of the focal spot on the target surface. Thus, vibration may compromise the quality of the x-ray image by causing undesirable movement of the focal spot.

There are various mechanisms by which high rotational speeds and extreme operating temperatures may cause increased vibration and noise in the bearing assembly. For example, excessively high temperatures can melt the thin film metal lubricant that is typically present on the ball bearings of the bearing assembly. When the bearings cool, the metal lubricant may clump and then create rough spots in the bearing races. Upon subsequent start-up of the x-ray device, the balls travel at high speeds over the rough spots in the races, thereby creating vibration and noise. Moreover, repeated exposure to high temperatures can degrade the bearings, thereby reducing their useful life as well as that of the x-ray tube.

Another mechanism by which high rotational speeds and extreme operating temperatures generate vibration and noise relates to the physical arrangement of the components in the bearing assembly and bearing housing, and the materials from which those components are constructed. In particular, in some known designs, heat generated at the anode and as a result of secondary electron impacts is conducted directly to the bearing assembly by way of solid metal parts that collectively form a heat path between the anode and the bearing assembly. Thus, operational heat is readily transmitted from the anode to the bearing assembly and related components. Additional heat is also generated in the bearing assembly as a result of bearing friction, which increases as operating speeds increase.

As a result of physical arrangements such as that just described, excessive heat coupled with high rotational speeds often causes the physical connections or interfaces in the shaft and bearing assembly to loosen and vibrate. Loosening can occur when the shaft and the bearing assembly are constructed of different metals that have different thermal expansion rates. In such a case, the various parts will each expand and contract at different respective rates when heated and cooled.

By way of example, the bearing housing is typically constructed of copper, or an alloy thereof. The bearings, which are generally constructed of a steel alloy are captured in the cavity formed by the housing. As the copper housing heats up, the diameter of the cavity increases more quickly than the outside diameter of the bearings, thereby creating a gap between the bearing and the cavity wall. The gap thus defined allows the bearings to move axially within the housing so as to generate noise and vibration.

While the aforementioned problems are cause for concern in all rotating anode type x-ray tubes, they are of particular concern in the new generation of high-power rotating anode x-ray tubes which have relatively higher operating temperatures than the typical devices. In general, high-powered x-ray devices have operating powers that exceed 20 kilowatts (kw).

Attempts have been made to minimize thermal stress, strain, vibration, noise, and other effects attributable to high operating temperatures, through the use of various types of x-ray tube cooling systems. However, currently available x-ray tube cooling systems and cooling media have not been entirely satisfactory in resolving these, and other, problems in the art. By way of example, conventional x-ray tube systems often utilize some type of liquid cooling arrangement. In many of such systems, a volume of a dielectric coolant is contained in a reservoir in which the x-ray tube is disposed. An external cooling unit continuously circulates coolant through the reservoir and removes heat transmitted to the coolant by the x-ray tube.

While these types of cooling systems and cooling processes have proven adequate in some applications, they are often ineffective to manage the significant amount of heat typically produced by high-power x-ray tubes. Further, many known cooling systems are directed towards achieving an overall cooling effect with respect to the x-ray tube, but are not directed specifically to the unique cooling requirements of the bearing assembly. That is, while such systems remove heat from the x-ray tube, they may nevertheless be ineffective in removing sufficient heat from localized "hot spots" such as the bearing assembly. As a result, the bearing assembly may fail prematurely, thereby shortening the useful life of the x-ray device.

In light of the foregoing problems, and others, it would be an advancement in the art to provide an improved x-ray tube cooling system which provides for a relative increase in the heat removed from the x-ray tube and thereby contributes to an increase of the operational life of the x-ray tube and related components. Further, the x-ray tube cooling system should provide for an increased rate of heat transfer out of the bearing assembly and related components.

BRIEF SUMMARY OF EMBODIMENTS OF THE INVENTION

The present invention has been developed in response to the current state of the art, and in particular, in response to these and other problems and needs that have not been fully or adequately resolved by currently available x-ray tube cooling systems. Briefly summarized, embodiments of the present invention provide an x-ray tube cooling system effective in facilitating an enhanced rate of heat transfer from the bearing assembly and related components of an x-ray tube.

Embodiments of the present invention are particularly well suited for use in the context of rotating anode type x-ray tubes. However, it will be appreciated that embodiments of the present invention may be suitable for use in conjunction with various other x-ray tubes and devices where it is desired to efficiently and reliably remove heat from bearing assemblies, and related components, that are exposed to high operating temperatures.

In one embodiment of the present invention, the x-ray tube cooling system includes a heat sink joined by welding, brazing, or similar process, to the bearing housing of a rotating anode type x-ray tube. The heat sink includes a substantially solid cooling block having a plurality of extended surfaces and composed of a high heat absorption material, preferably copper or the like. In addition, the heat sink includes a shell that cooperates with the cooling block so as to define a coolant chamber substantially enclosing the extended surfaces. The shell also defines, or otherwise includes, a coolant chamber entrance and exit that are in fluid communication with the coolant chamber.

The bearing housing, wherein the bearing assembly of the x-ray tube is received, and the heat sink are supported in a cantilever position in the vacuum enclosure of the x-ray tube by a pair of insulators, preferably ceramic or the like, disposed about one end of the heat sink. Furthermore, the insulators also serve to isolate the anode from the vacuum enclosure, and thereby preserve the high voltage potential between the anode and the cathode that is required for effective operation of the x-ray device. In addition to the support function and the electrical isolation function that they provide, the insulators also cooperate with each other to define coolant inlet and outlet passageways in fluid communication with the coolant chamber entrance and exit, respectively, of the shell, and thereby permit a flow of dielectric coolant, preferably supplied by an external cooling unit, to enter the vacuum enclosure and circulate through the coolant chamber of the heat sink.

In operation, some of the heat generated during x-ray tube operations is transmitted to the bearing assembly. By virtue of the intimate and substantial contact between the bearing housing, in which the bearing assembly is received, and the substantially solid copper cooling block of the heat sink, a relatively large amount of the heat transmitted to the bearing assembly is conducted out to the cooling block. The heat present in the cooling block is continuously removed by a flow of coolant generated by the external cooling unit.

In particular, the flow of coolant is directed to the coolant chamber of the heat sink by way of the coolant inlet passageway defined by the insulators, and the coolant chamber entrance of the shell. Upon entering the coolant chamber, the flow of coolant contacts the extended surfaces of the cooling block so as to remove at least some heat therefrom. Because heat transfer rate is a function of, among other things, the total surface area over which heat is to be transferred, the extended surfaces are effective in implementing a rate of heat transfer away from the bearing assembly that is relatively greater than would otherwise be the case. After absorbing heat from the extended surfaces, the coolant then exits the coolant chamber and returns to the external cooling unit by way of the coolant chamber exit of the shell and the coolant outlet passageway defined by the insulators. The heated coolant is then cooled by the external cooling unit and directed back to the coolant chamber to repeat the cycle.

Thus, embodiments of the present invention are effective in providing, among other things, localized cooling at the bearing assembly and related components. In this way, the present invention contributes to a relative increase in the operational life of the bearing assembly and related components, and thus, the operational life of the x-ray device as a whole.

These and other aspects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF VARIOUS EMBODIMENTS

Reference will now be made to figures wherein like structures will be provided with like reference designations. It is to be understood that the drawings are diagrammatic and schematic representations of various embodiments of the claimed invention, and are not to be construed as limiting the present claimed invention, nor are the drawings necessarily drawn to scale.

Figure 1:
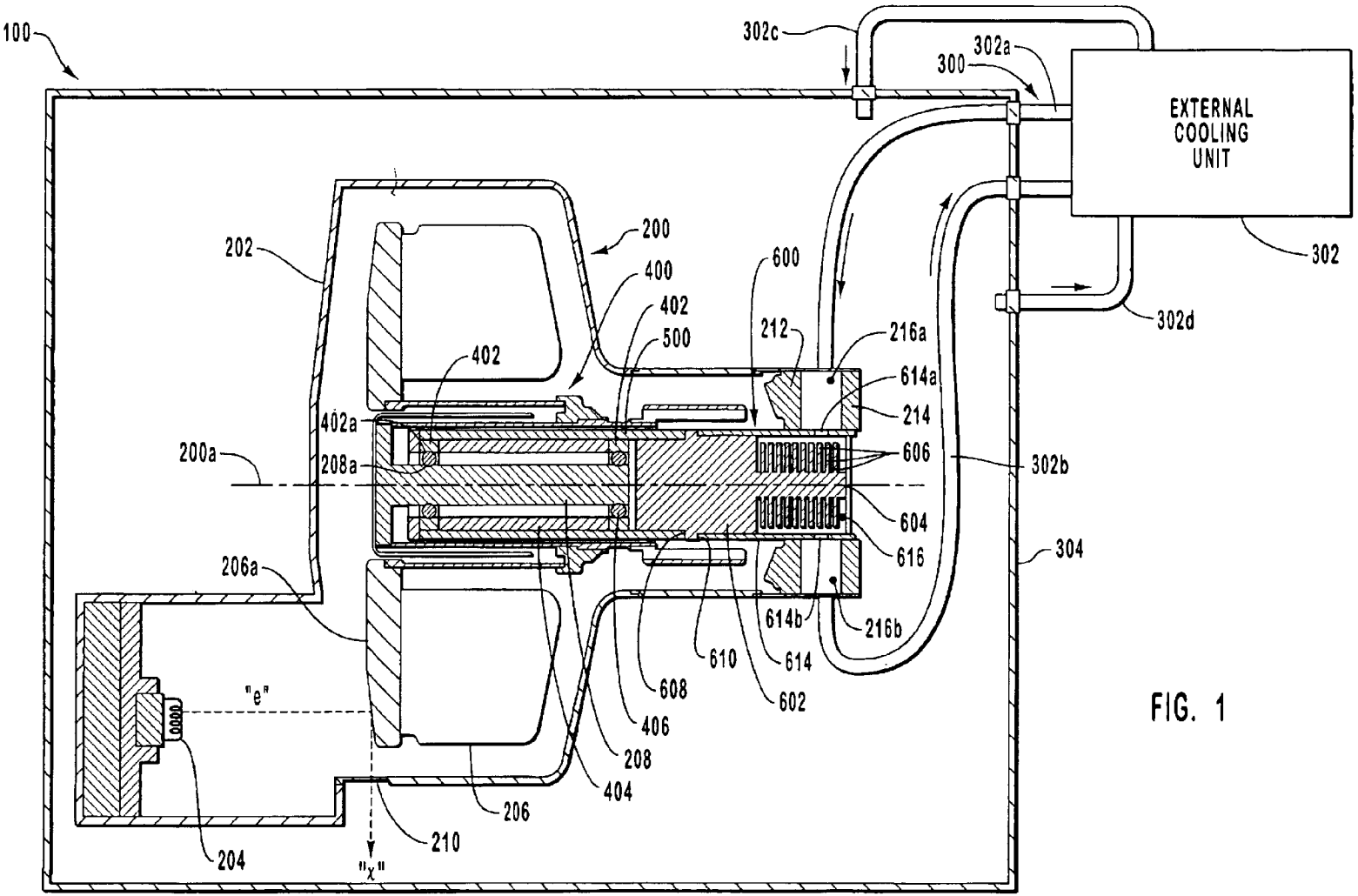
FIG. 1 is a section view illustrating various features of an embodiment of an x-ray tube cooling system.

Reference is first made to FIG. 1, wherein an x-ray device is indicated generally at 100. In general, x-ray device 100 includes an x-ray tube 200 which generates x-rays, and an x-ray tube cooling system 300 which serves to remove at least some of the heat produced as a result of the x-ray generation process. It will be appreciated that the x-rays produced by x-ray tube 200 may be employed in any of a variety of applications, and embodiments of the present invention should accordingly not be construed to be limited to any particular field of application.

As indicated in the illustrated embodiment, x-ray tube 200 includes a vacuum enclosure 202, inside which is disposed an electron source 204, preferably comprising a cathode or the like, and an anode 206 mounted to a shaft 208 and arranged in a spaced apart configuration with respect to electron source 204. Anode 206 further includes a target surface 206A, preferably comprising a refractory metal such as tungsten or the like, arranged so as to receive electrons emitted by electron source 204. The x-rays produced by x-ray tube 200 are directed out of vacuum enclosure 202 by way of a window 210, preferably comprising beryllium or the like.

A bearing assembly 400, contained in a bearing housing 500, receives and rotatably supports shaft 208 upon which anode 206 is mounted. Generally, bearing assembly 400 include a plurality of bearing rings 402, each of which defines an outer bearing race 402A corresponding to a respective inner bearing race 208A defined by shaft 208. Preferably, bearing rings 402 are separated by one or more spacers 404, which serve to, among other things, ensure proper relative positioning between outer bearing races 402A and their corresponding inner bearing races 208A. Further, a plurality of balls 406 are disposed between, and retained by, each pair of inner bearing races 208A and outer bearing races 402A, so as to facilitate relative rotary motion of shaft 208, and thus anode 206, with respect to bearing assembly 400. Finally, insulators 212 and 214, discussed in greater detail below, serve to maintain bearing assembly 400 and anode 206 in a cantilever arrangement within vacuum enclosure 202, as well as to preserve the electrical potential between bearing assembly 400 and vacuum enclosure 202.

Preferably, shaft 208, bearing rings 402, spacer 404, and balls 406 are each composed of a high strength metal or metal alloy, including, but not limited to, stainless steel and the like. However, any metal or metal alloy suitable for sustained exposure to high temperatures, such as are typically experienced in x-ray tube operating environments, is contemplated as being within the scope of the present invention.

Figure 2:
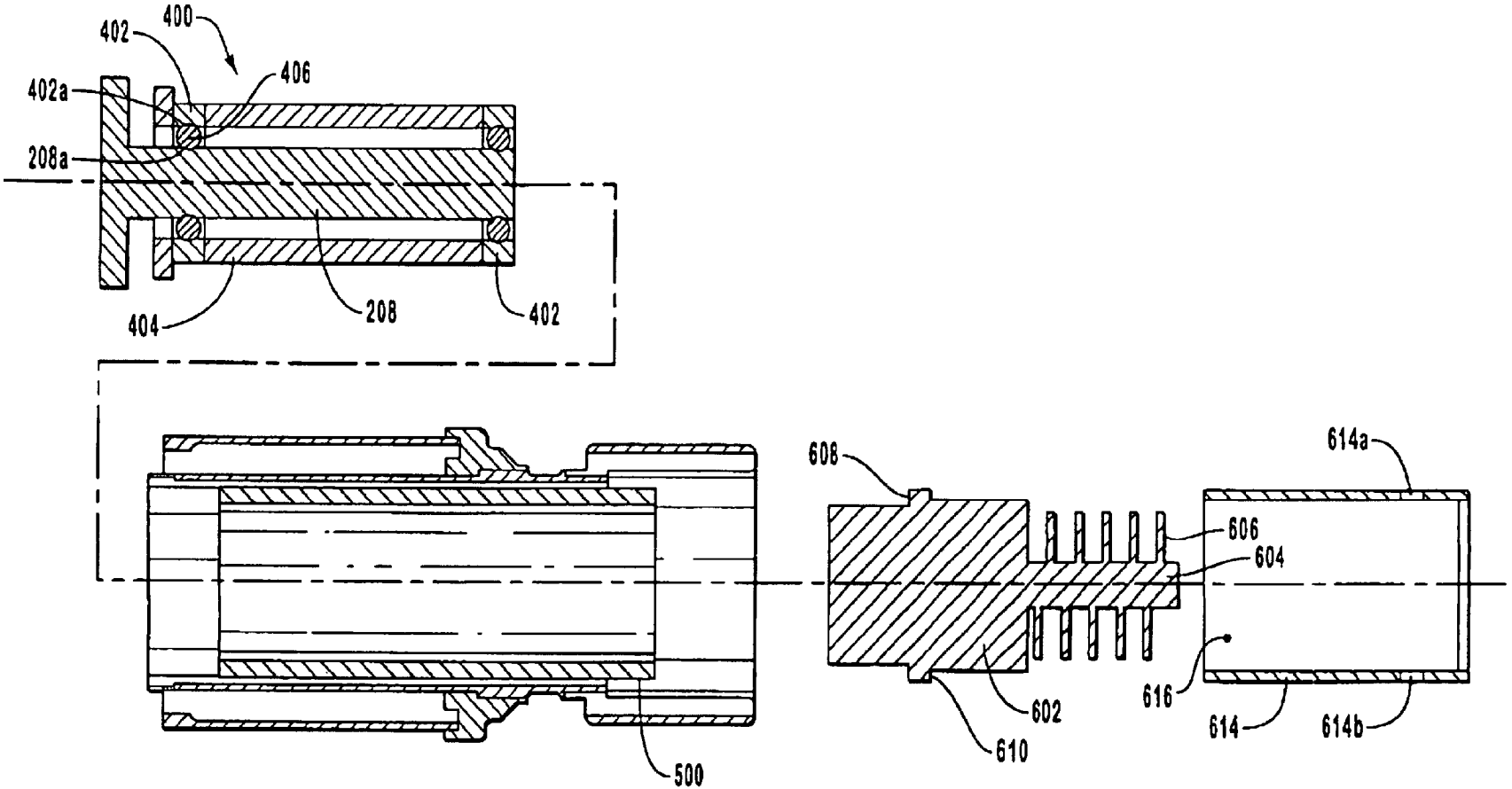
FIG. 2 is an exploded section view illustrating various aspects of the relation between a bearing assembly and an embodiment of a heat sink.

With continuing attention to FIG. 1, and directing attention now to FIG. 2, bearing housing 500, in which bearing assembly 400 is disposed, is substantially in the shape of a seamless hollow cylinder having an inside diameter somewhat larger than the outside diameter of bearing assembly 400 and preferably comprises a durable, high strength metal or metal alloy, such as stainless steel and the like, that is suitable for use in high temperature x-ray tube operating environments. In one embodiment of the invention, bearing assembly 400 is securely retained within bearing housing 500 by a plurality of screws (not shown). However, it will be appreciated that various other devices and methods may be employed to removably secure bearing assembly 400 in bearing housing 500.

As noted above, x-ray device 100 additionally includes an x-ray tube cooling system 300 that is effective in removing at least some of the heat produced during the x-ray generation process. With continuing attention to FIGS. 1 and 2, and directing attention now to FIG. 3, additional details are provided concerning various features of x-ray tube cooling system 300. Generally, x-ray tube cooling system 300 includes a heat sink 600, preferably at least partially disposed within vacuum enclosure 202, arranged for substantial thermal communication with bearing assembly 400 and bearing housing 500, and an external cooling unit 302 which continuously circulates a flow of coolant into contact with heat sink 600 so as to remove at least some of the heat present in bearing assembly 400 and bearing housing 500. Further, x-ray tube cooling system 300 includes a reservoir 304, containing a volume of coolant and in fluid communication with external cooling unit 302, in which at least a portion of x-ray tube 200 is immersed. Thus, in addition to supplying a flow of coolant directed to heat sink 600, external cooling unit 302 also continuously supplies a flow of coolant to reservoir 304 so as to remove heat from various other portions of x-ray tube 200 as well.

Directing particular attention now to FIGS. 1 and 2, heat sink 600 is preferably cylindrical in shape and includes a cooling block 602 having a post 604 which supports a plurality of extended surfaces 606. In one embodiment of the invention, extended surfaces 606 are oriented so as to be substantially perpendicular to an axis of rotation 200A of x-ray tube 200, however, as discussed below, various other orientations of extended surfaces 606 may be employed. Cooling block 602 defines a shoulder 608 configured to engage bearing housing 500 so that a portion of cooling block 602 is received within bearing housing 500 (FIG. 1), and further defines shoulder 610 configured to engage a shell, discussed in greater detail below, enclosing extended surfaces 606. It will be appreciated that various other geometries and arrangements may be employed to connect cooling block 602 to bearing housing 500 so as to ensure substantial thermal communication therebetween, and such other geometries and arrangements are contemplated as being with the scope of the present invention.

Cooling block 602 and bearing housing 500 are preferably joined together by welding, brazing, or any other process which is effective in providing a high strength and durable connection. As discussed in greater detail below, the intimate and substantial thermal contact between cooling block 602 and bearing housing 500, in which bearing assembly 400 is received, is effective in facilitating a relatively high rate of heat transfer from bearing assembly 400 to cooling block 602.

Preferably, cooling block 602, post 604, and extended surfaces 606 collectively form a single, integral element composed substantially of copper or other high heat absorption metals or metal alloys. It will be appreciated however that any, or all, of the aforementioned components of heat sink 600 may be manufactured separately and then joined by a suitable process, such as welding, brazing or the like, to the other component(s). In either event, it will likewise be appreciated that heat sink 600 and its constituent elements, cooling block 602, post 604, and extended surfaces 606, are relatively simple in form and may be quickly and easily manufactured and/or assembled by any of a variety of well known processes and techniques. Furthermore, the durability of heat sink 600, and its constituent elements, renders them relatively impervious to rough handling and the like such as may occur during the x-ray device assembly process and related processes.

Finally, while copper or copper alloys are preferred construction materials for cooling block 602, post 604, and extended surfaces 606 of heat sink 600, the present invention contemplates as within its scope the use of any other high heat absorption metal or metal alloys that would provide the same benefits as copper or a copper alloy. Finally, it will be appreciated that cooling block 602, post 604, and extended surfaces 606 may each be constructed from a different metal, if required to suit a particular application or to facilitate achievement of one or more desired results.

With respect to the geometric features of post 604 and extended surfaces 606, it will be appreciated that variables including, but not limited to, the size, shape, number, and arrangement of extended surfaces 606 may be varied either alone or in combination as required to suit a particular application and/or to facilitate achievement of one or more desired results. In one embodiment, extended surfaces 606 comprise a plurality of annular fins evenly spaced along the length of post 604. In another embodiment, extended surface (s) 606 comprises a single, helical fin disposed about post 604. Further, variables including, but not limited to, the length, diameter, arrangement, number, and shape of post 604 may be varied, either alone or in combination, as required to suit a particular application. For example, in one embodiment, a plurality of posts 604 are provided, each supporting one or more extended surfaces 606.

Figure 4:
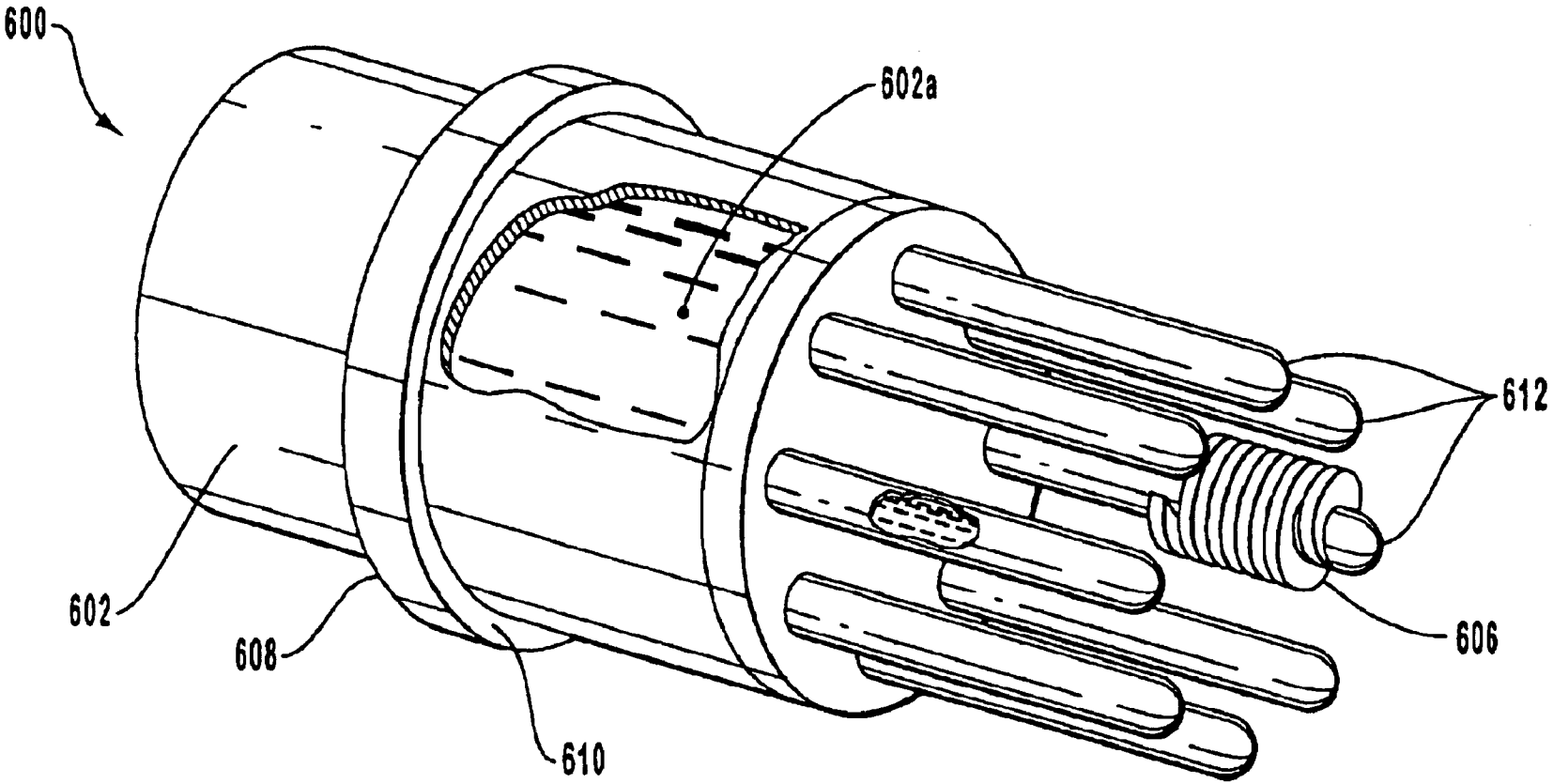
FIG. 4 depicts an alternative embodiment of a heat sink.

Directing attention now to FIG. 4, an alternative embodiment of heat sink 600 includes one or more heat pipes 612 in fluid communication with a block coolant chamber 602A defined by cooling block 602 and containing a volume of an appropriate coolant. Exemplary coolants include, but are not limited to, Shell Diala Oil AX or Dow Syltherm 800, and various alcohol-based coolants. Preferably, heat pipes 612 comprise copper or a copper alloy. However, other high heat absorption metals may profitably be substituted for copper.

In a well known process, beat pipe(s) 612 transfer heat away from cooling block 602, and ultimately to a circulating coolant in contact with heat sink 600, by way of capillary movement of the coolant disposed within block coolant chamber 602A and heat pipes 612. It will be appreciated that variables including, but not limited to, the size, number, shape, and arrangement of heat pipes 612 may be varied as required to suit a particular application and/or to facilitate achievement of one or more desired results. It will likewise be appreciated that heat pipes 612 may be used either alone, or in conjunction with extended surfaces 606. For example, some embodiments of the present invention include one or more extended surfaces 606 attached to one or more heat pipes 612.

Finally, it will be appreciated that a variety of means may be profitably employed to perform the functions, enumerated herein, of post 604 and extended surfaces 606, and heat pipes 612 (in conjunction with block coolant chamber 602A). Accordingly, structural configurations including, but not limited to: post 604 and extended surfaces 606; heat pipes 612 (in conjunction with block coolant chamber 602A); and, heat pipes 612 (in conjunction with block coolant chamber 602A) and extended surfaces 606, are but examples of a means for transferring heat. It should thus be understood that such structural configurations are presented herein solely by way of example and should not be construed as limiting the scope of the present invention in any way.

Figure 3:
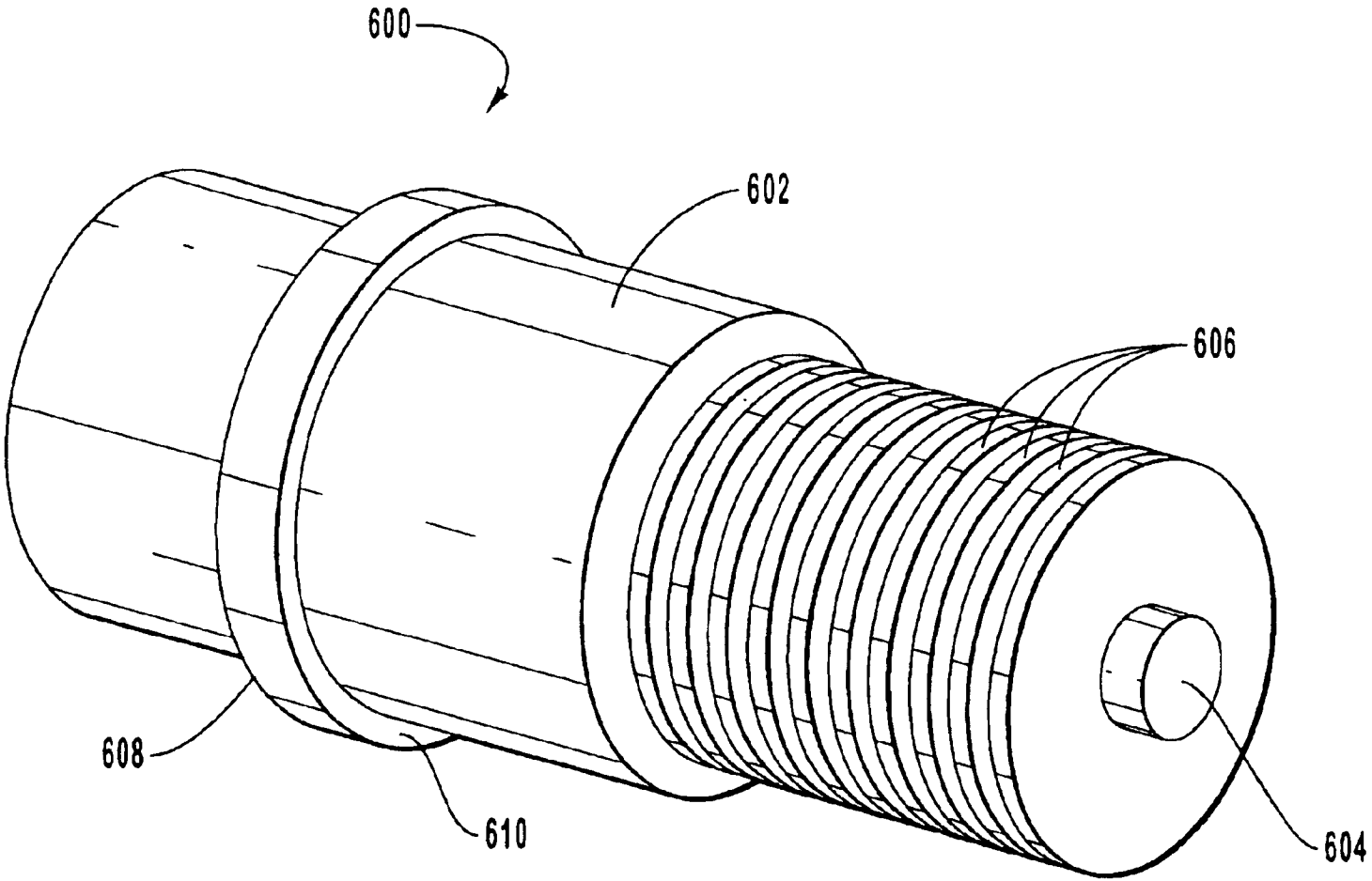
FIG. 3 is a perspective view illustrating various features of an embodiment of a heat sink.

Directing renewed attention now to FIGS. 1 through 3, embodiments of heat sink 600 additionally include a shell 614, preferably cylindrical in shape and comprising a metal or metal alloy such as high strength steel or the like, which cooperates with cooling block 602 to define a coolant chamber 616 that substantially encloses post 604 and extended surfaces 606. Additionally, shell 614 defines, or otherwise includes, a coolant chamber entrance 614A and a coolant chamber exit 614B, each of which is in fluid communication with coolant chamber 616.

As best illustrated in FIGS. 1 and 2, shoulder 610 of cooling block 602 is configured and arranged so that a portion of cooling block 602 is received within shell 614 (FIG. 1). It will be appreciated however, that cooling block 602 may be connected with shell 614 by structures of various other geometric configurations. Preferably, cooling block 602 is joined to shell 614 by welding, brazing, or the like.

Finally, shell 614, and thereby, anode 206, bearing assembly 400, bearing housing 500, and cooling block 602, is supported in a cantilever arrangement within vacuum enclosure 202 by way of insulators 212 and 214, as indicated in FIG. 1. Insulators 212 and 214 comprise an electrically non-conductive material, such as glass, ceramic, or the like, that is sufficiently strong to securely and rigidly support, in cantilever fashion, the combined weight of shell 614, anode 206, bearing assembly 400, bearing housing 500, and cooling block 602. Note however, that embodiments of the present invention are not to be construed to be restricted to such cantilever support arrangements. Rather, it will be appreciated that embodiments of the present invention are likewise suitable for use in conjunction with arrangements where shell 614, anode 206, bearing assembly 400, bearing housing 500, and cooling block 602 are supported at two or more points within vacuum enclosure 202.

With respect to the arrangement of shell 614, bearing housing 500, and insulators 212 and 214, it will be appreciated that various benefits are provided thereby. As noted earlier, both shell 614 and bearing housing 500 are preferably composed of a high strength steel or similar metal. Thus, bearing housing 500 and shell 614 serve to, among other things, collectively provide a strong and durable structure that is well suited to the rigors of operating in an x-ray tube environment. Specifically, the collective strength and stiffness of bearing housing 500 and shell 614 are effective in providing reliable support to bearing assembly 400 and anode 206 so as to substantially preventing undesirable lateral movement or vibration of anode 206 that could compromise the performance of x-ray device 100. It will be appreciated that such features are particularly useful in the context of cantilever type anode support arrangements, an embodiment of which is illustrated in FIG. 1.

In addition to supporting shell 614, anode 206, bearing assembly 400, bearing housing 500, and cooling block 602, insulators 212 and 214 also cooperate with each other to define coolant inlet passageway 216A and coolant outlet passageway 216B which are in fluid communication with coolant chamber entrance 614A and a coolant chamber exit 614B, respectively. In an alternative embodiment, a single insulator is employed which defines coolant inlet and outlet passageways.

With continuing reference to FIG. 1, external cooling unit 302 of x-ray tube cooling system 300 includes fluid conduits 302A and 302B connected to coolant inlet passageway 216A and coolant outlet passageway 216B, respectively, and which serve to convey coolant to and from, respectively, coolant chamber 616. In general, external cooling unit 302 comprises any of a variety of known external cooling units that include, among other things, pumps, heat exchangers, instrumentation, secondary coolant, piping, and the like. The coolant circulated by external cooling unit 302 through coolant chamber 616 comprises a dielectric coolant such as, but not limited to, Shell Diala Oil AX or Dow Syltherm 800. It will be appreciated that various other coolants having similar properties may likewise be usefully employed in conjunction with embodiments of the present invention.

Finally, as noted earlier, x-ray tube cooling system 300 preferably includes a reservoir 304 containing a volume of coolant in which a portion of x-ray tube 200 is immersed. External cooling unit 302 communicated with reservoir 304 by way of fluid conduits 302C and 302D. Note that, in one embodiment of the invention, fluid conduits 302A and 302C are fed from a common header connected to external cooling unit 302, and in similar fashion, fluid conduits 302B and 302D return to a common header connected to external cooling unit 302.

With attention now to FIGS. 1 through 3, additional details are provided regarding various operational features of the present invention. In operation, a stator (not shown) causes shaft 208, and thus anode 206, to rotate at high speed. Power applied to electron source 204 causes electrons, denoted at "e" in FIG. 1, to be emitted by thermionic emission and a high voltage potential applied across electron source 204 and anode 206 causes the emitted electrons "e" to rapidly accelerate from electron source 204 toward anode 206. Upon reaching anode 206, electrons "e" strike target surface 206A causing x-rays, denoted at "x" in FIG. 1 to be produced. The x-rays "x" are then collimated and passed through window 210 and into a subject, for example, the body of a patient.

While electrons "e" are being emitted from electron source 204, anode 206 rotates at high speed so that the portion of target surface 206A that is exposed to the electron beam changes continuously over time. In this way, the heat generated as a result of the x-ray production process is evenly distributed across target surface 206A. However, as a result of the close proximity of bearing assembly 400 and bearing housing 500 with respect to target surface 206A of anode 206, bearing assembly 400 and bearing housing 500 absorb a significant amount of heat. The heat absorbed by bearing assembly 400 is then transmitted to cooling block 602 of heat sink 600 by way of bearing housing 500.

As a result of its copper construction and its intimate and substantial thermal connection with bearing housing 500, cooling block 602 cooperates with bearing housing 500 to define an efficient thermal path for heat present in bearing assembly 400 and is thereby effective in absorbing a significant amount of heat from bearing assembly 400, as well as absorbing some heat from other x-ray tube 200 structures and components. Thus, embodiments of the present invention are effective in, among other things, removing destructive heat from bearing assembly 400 and thereby contributing to an increase in the operational life of both bearing assembly 400 and x-ray device 100 as a whole.

The heat thus absorbed by cooling block 602 then passes to extended surfaces 606 from which it is substantially removed by a flow of dielectric coolant through coolant chamber 616. In particular, external cooling unit 302 of x-ray tube cooling system 300 generates a flow of dielectric coolant that is directed through fluid conduit 302A to coolant inlet passageway 216A, defined by insulators 212 and 214, and then through coolant chamber entrance 614A of shell 614 and into coolant chamber 616. Upon entering coolant chamber 616, the dielectric coolant contacts extended surfaces 606 so as to absorb at least some of the heat therefrom. Because the rate of heat transfer is a function of, among other things, the size of the surface area across which the transfer will occur, the relative increase in surface area provided by extended surfaces 606 is effective in efficiently transferring heat from cooling block 602 to the circulating dielectric coolant.

In addition to supplying a flow of coolant to heat sink 600, external cooling unit 302 also supplies a flow of coolant to reservoir 304 by way of fluid conduit 302C. The coolant from external cooling unit 302 enters reservoir 304 and contacts various surfaces and structures of x-ray tube 200. After absorbing heat from x-ray tube 200, the heated coolant then exits reservoir 304 by way of fluid conduit 302D and returns to external cooling unit 302 where it is cooled and then returned to reservoir 304 to repeat the cycle. It will be appreciated that some embodiments of the invention provide for configurations wherein external cooling unit 302 is a dedicated unit that serves only heat sink 600. In such embodiments, the coolant directed to reservoir 304 for cooling other portions of x-ray tube 200 is supplied by another external cooling unit (not shown).

After absorbing heat from extended surfaces 606, the dielectric coolant then exits coolant chamber 616 by way of coolant chamber exit 614B and passes through coolant outlet passageway 216B, defined by insulators 212 and 214, before returning to external cooling unit 302 by way of fluid conduit 302B. Alternatively, fluid conduit 302B may be eliminated so that coolant exiting coolant chamber 614B enters directly into reservoir 304 and then returns to external cooling unit 302 by way of fluid conduit 302D. In either case, external cooling unit 302 then cools the heated coolant and directs a flow of coolant back to coolant chamber 610 and to reservoir 304 to repeat the cycle.

In sum, embodiments of the invention are characterized by a variety of advantages and useful features, a few of which are briefly summarized in the following discussion. One exemplary advantage of embodiments of the present invention is that the various constituent components of embodiments of the present invention, including, but not limited to, bearing housing 500, cooling block 602, and shell 614 are relatively simple in form and thus are readily and inexpensively manufactured and assembled. Accordingly, embodiments of the present invention represent an advancement in the art over, among other things, those known devices and systems that require the use of complex, and therefore expensive, manufacturing and/or assembly processes.

As another example, embodiments of the present invention are effective in providing for an enhanced rate of heat transfer out of the bearing assembly and related components, and thereby contribute to an increase in the operational life of both the bearing assembly, and related components, and the x-ray device as a whole.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A rotating anode x-ray device, comprising:

(a) a vacuum enclosure;

(b) an electron source and an anode disposed in said vacuum enclosure, said anode being mounted to a shaft and spaced apart from said electron source so that said anode receives electrons emitted by said electron source;

(c) a bearing assembly rotatably supporting said shaft upon which said anode is mounted;

(d) a bearing housing wherein said bearing assembly is substantially confined; and (e) a heat sink at least partially disposed within said vacuum enclosure and including:

(i) a cooling block directly joined to said bearing housing and having at least one extended surface;

(ii) a shell directly joined to said cooling block and cooperating therewith to define a coolant chamber; and (iii) a means for transferring heat, said means for transferring heat facilitating transfer of heat from said cooling block to coolant disposed in said coolant chamber.

2. The x-ray device as recited in claim 1, further comprising at least one insulator, said at least one insulator being disposed about said shell so as to support said shell in a predetermined position inside said vacuum enclosure.

3. The x-ray device as recited in claim 2, wherein said at least one insulator comprises two insulators.

4. The x-ray device as recited in claim 2, where said coolant chamber includes a coolant chamber entrance and coolant chamber exit.

5. The x-ray device as recited in claim 4, wherein said at least one insulator defines coolant inlet and outlet passageways in fluid communication with said coolant chamber entrance and coolant chamber exit, respectively.

6. The x-ray device as recited in claim 1, wherein said means for transferring heat comprises a post joined to said cooling block and including at least one extended surface in contact with said coolant disposed in said coolant chamber.

7. The x-ray device as recited in claim 1, wherein said means for transferring heat comprises at least one heat pipe having an interior portion in fluid communication with a block coolant chamber defined by said cooling block and containing a volume of coolant.

8. The x-ray device as recited in claim 1, wherein said cooling block is at least partially received within the bearing housing.

9. In an x-ray device having an evacuated housing wherein is disposed an anode mounted to a shaft rotatably supported by a bearing assembly, the bearing assembly being disposed in a bearing housing, an x-ray tube cooling system comprising:

(a) a heat sink at least partially disposed within the evacuated housing and including:

(i) a cooling block directly joined to the bearing housing and having at least one extended surface; and (ii) a shell directly joined to said cooling block and cooperating with said cooling block to define a coolant chamber substantially enclosing said at least one extended surface, and said shell including a coolant chamber entrance and coolant chamber exit in fluid communication with said coolant chamber; and (b) an external cooling unit in fluid communication with said coolant chamber entrance and coolant chamber exit and circulating a flow of coolant into contact with said at least one extended surface so as to remove at least some heat from the bearing assembly.

10. The x-ray tube cooling system as recited in claim 9, wherein said coolant comprises a dielectric fluid.

11. The x-ray tube cooling system as recited in claim 9, farther comprising a coolant reservoir in which at least a portion of the x-ray device is disposed, said coolant reservoir being in fluid communication with said external cooling unit.

12. The x-ray tube cooling system as recited in claim 9, wherein said heat sink includes at least one post joining said cooling block with said at least one extended surface.

13. The x-ray tube cooling system as recited in claim 9, wherein said heat sink includes at least one heat pipe having an interior portion in fluid communication with a block coolant chamber defined by said cooling block and containing a volume of coolant.

14. The x-ray tube cooling system as recited in claim 9, wherein at least a portion of said heat sink is substantially composed of a metal selected from the group consisting of: copper, and copper alloys.

15. In an x-ray device having an evacuated housing wherein is disposed an anode mounted to a shaft rotatably supported by a bearing assembly, the bearing assembly being disposed in a bearing housing, a heat sink for facilitating removal of at least some heat from the bearing assembly, the heat sink being at least partially disposed within the evacuated housing and comprising:

(a) a cooling block configured for directly attachment to the bearing housing and having at least one extended surface; and (b) a shell directly joined to said cooling block and cooperating with said cooling block to define a coolant chamber substantially enclosing said at least one extended surface, and said shell including a coolant chamber entrance and coolant chamber exit in fluid communication with said coolant chamber.

16. The heat sink as recited in claim 15, wherein at least a portion of said cooling block is substantially composed of a metal selected from the group consisting of: copper, and copper alloys.

17. The heat sink as recited in claim 15, wherein said at least one extended surface comprises a plurality of annular fins.

18. The heat sink as recited in claim 15, wherein said at least one extended surface is substantially composed of a metal selected from the group consisting of: copper, and copper alloys.

19. The heat sink as recited in claim 15, wherein said at least one extended surface is integral with said cooling block.

20. The x-ray device as recited in claim 15, wherein said cooling block is at least partially received within said shell.

21. The heat sink as recited in claim 15, further comprising at least one heat pipe having an interior portion in fluid communication with a block coolant chamber defined by said cooling block and containing a volume of coolant.

22. The heat sink as recited in claim 21, wherein said at least one extended surface is joined to said at least one heat pipe.

23. The heat sink as recited in claim 15, further comprising at least one post joining said cooling block with said at least one extended surface.

24. The heat sink as recited in claim 23, wherein said at least one extended surface a comprising a substantially continuous helical fin disposed about said at least one post.

* * * * *

UNITED STATES PATENT AND TRADEMARK OFFICE

CERTIFICATE OF CORRECTION

PATENT NO. : 6,778,635 B1
DATED : August 17, 2004
INVENTOR(S) : John E. Richardson It is certified that error appears in the above-identified patent and that said Letters Patent is hereby corrected as shown below:

Column 6,
Line 8, change “include” to -- includes --

Column 8,
Line 14, before “pipe(s)” change “beat” to -- heat --

Column 9,
Line 21, after “substantially” change “preventing” to -- prevent --
Line 56, after “302” change “communicated” to -- communicates --

Column 13,
Line 1, before “attachment” change “directly” to -- direct --

Column 14,
Line 17, after “surface” change “a comprising” to -- comprises --

Signed and Sealed this

Eighteenth Day of January, 2005

JON W. DUDAS
*Director of the United States Patent and Trademark Office*